US005481336A

United States Patent [19]

Tachibana et al.

[11] Patent Number: 5,481,336

[45] Date of Patent: Jan. 2, 1996

[54] IMAGE RECORDING APPARATUS WITH MULTIPLE FEED DETECTION AND PAPER FEED CONTROL

[75] Inventors: Tatsuto Tachibana, Kawasaki; Izumi Narita, Koganei; Akihisa Kusano; Yuzo Seino, both of Kawasaki; Kaoru Sato, Yokohama, all of Japan

[73] Assignee: Canon Kabushiki Kaisha, Tokyo, Japan

[21] Appl. No.: 921,643

[22] Filed: Jul. 30, 1992

[30] Foreign Application Priority Data

Aug. 1, 1991 [JP] Japan ..... 3-193185

[51] Int. Cl.[6] ..... G03G 21/00

[52] U.S. Cl. ..... 355/207; 355/309

[58] Field of Search ..... 355/205, 207, 355/308, 309, 316; 271/259, 265

[56] References Cited

U.S. PATENT DOCUMENTS

| | | | |
|---|---|---|---|
| 4,247,193 | 1/1981 | Kaneko et al. | 355/206 |
| 4,478,506 | 10/1984 | Miyoshi et al. | 355/309 X |
| 4,580,890 | 4/1986 | Sugizaki et al. | 355/309 |
| 4,733,281 | 3/1988 | Yoshinaga et al. | 355/309 X |
| 4,750,020 | 6/1988 | Ishizu et al. | 355/205 |
| 4,763,162 | 8/1988 | Yagasaki | 355/207 |
| 4,804,998 | 2/1989 | Miyawaki | 355/206 |
| 5,049,924 | 9/1991 | Moro et al. | 355/207 |
| 5,091,754 | 2/1992 | Abe et al. | 355/317 |

*Primary Examiner*—Robert Beatty

*Attorney, Agent, or Firm*—Fitzpatrick, Cella, Harper & Scinto

[57] ABSTRACT

An image forming apparatus includes recording structure for recording an image on a recording medium, first and second conveying structures for conveying the recording medium to the recording structure, detecting structure for detecting a plurality of multi-fed recording media fed by the conveying structure, and control structure for controlling the first and second conveying structures so that an image is recorded on a recording medium separated from the multi-fed recording media and detected by the detecting structure or discharged from the image forming apparatus.

11 Claims, 11 Drawing Sheets

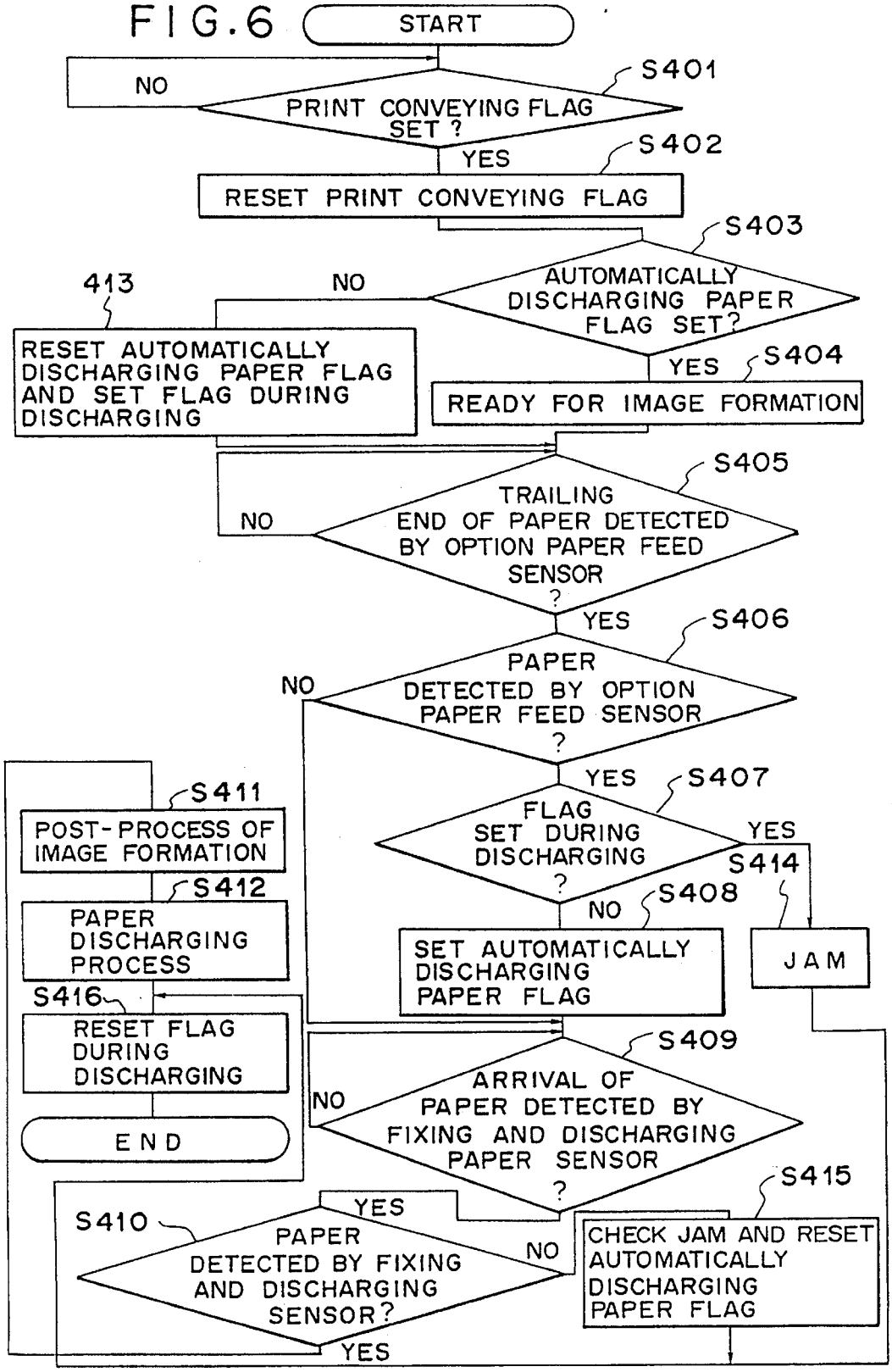
FIG.6
START
S401
PRINT CONVEYING FLAG SET ?
NO
YES
S402
RESET PRINT CONVEYING FLAG
S403
AUTOMATICALLY DISCHARGING PAPER FLAG SET?
NO
413
RESET AUTOMATICALLY DISCHARGING PAPER FLAG AND SET FLAG DURING DISCHARGING
YES
S404
READY FOR IMAGE FORMATION
S405
TRAILING END OF PAPER DETECTED BY OPTION PAPER FEED SENSOR ?
NO
YES
S406
PAPER DETECTED BY OPTION PAPER FEED SENSOR ?
NO
YES
S407
FLAG SET DURING DISCHARGING ?
YES
S414
NO
S408
SET AUTOMATICALLY DISCHARGING PAPER FLAG
JAM
S411
POST-PROCESS OF IMAGE FORMATION
S412
PAPER DISCHARGING PROCESS
S416
RESET FLAG DURING DISCHARGING
END
S409
ARRIVAL OF PAPER DETECTED BY FIXING AND DISCHARGING PAPER SENSOR ?
NO
S415
CHECK JAM AND RESET AUTOMATICALLY DISCHARGING PAPER FLAG
S410
PAPER DETECTED BY FIXING AND DISCHARGING SENSOR?
YES
NO
YES

IMAGE RECORDING APPARATUS WITH MULTIPLE FEED DETECTION AND PAPER FEED CONTROL

BACKGROUND OF THE INVENTION

1. Field of the Invention

The present invention relates to an image recording apparatus for feeding sheets of paper using feed means.

2. Related Background Art

An image recording apparatus conventionally is provided with a built-in paper feeder, an option paper feeder (for feeding envelopes, postcards and the like) detachable from the image recording apparatus, and an option paper feed sensor for detecting recording paper on a conveying passage extending from the option paper feeder to the built-in paper feeder. In the case where recording paper fed from the option paper feeder is fed via the built-in paper feeder to a recording unit of the apparatus if the option paper feed sensor is still detecting the paper after a predetermined period of time has passed since a starting timing of the built-in paper feeder, then the apparatus determines that a paper jam has occurred. Then a process of dealing with jamming is performed.

However, such apparatus has the following drawbacks because a paper jam is detected even when multiple sheets of paper double fed from the option paper feeder are separated by the built-in feeder, with one sheet remaining behind the other.

(1) Even when the remaining sheet of paper can be fed regularly by the built-in paper feeder and set for normal printing, the operator must go through a process of removing the remaining sheet of paper to release the jamming condition.

(2) When jamming is detected because of the remaining sheet of paper while the printing of the preceding paper is in progress, a process of reprinting the same picture is needed as printing is interrupted at that point of time.

(3) When jamming is detected because of the remaining sheet of paper while the printing of the preceding paper is in progress, the paper being put into print is wasted and besides the remaining sheet of paper may be made unusable again at the time it is removed from the feeder.

(4) As the external paper feeder must be provided with a stack feed preventive function to obviate the foregoing shortcomings (1)–(3), the system tends to become complicated in configuration and costly.

Especially when a built-in paper feed mechanism is equipped with an effective stacked sheet separating function, the remaining sheet of double fed paper may properly be fed in most cases. As a result, the aforementioned problems (1)–(3) are highlighted and as to (4), both the external paper feeder and the built-in paper feed mechanism are each provided with such functions similar to each other, which also involves waste.

SUMMARY OF THE INVENTION

An object of the present invention is to provide an image recording apparatus designed to solve the foregoing technical problems simultaneously with those resulting from stack feeding without causing waste and complication in construction when it is supplied with an external paper feeder.

An image recording apparatus according to the present invention comprises a first sheet feed means for feeding sheets of paper, a second sheet feed means for feeding sheets of paper to the first sheet feed means, a first sheet detecting means for detecting sheets of paper, the first sheet detecting means being provided between the first and second sheet feed means, and a second sheet detecting means for detecting sheets of paper in a conveying passage on the downstream side of the first sheet feed means at a position where the distance between the first and second sheet detecting means is greater than a distance from a sheet of maximum size for use, the image recording apparatus further comprising a jamming detection means for detecting jamming at the timing at which the second sheet detecting means detects a sheet of paper after it is fed by the first sheet feed means, wherein when no jamming is detected by the jamming detection means after sheets of paper fed by the second sheet feed means are fed via the first sheet feed means to the image recording apparatus, whether or not sheets of paper are fed in a stack is determined, depending on whether or not the first sheet detecting means is detecting a remaining sheet. In other words, one of the sheets of paper fed in a stack from the second sheet feed means may be detected as a remaining sheet if the first sheet detecting means is detecting that sheet.

When one of the sheets of paper fed in a stack from the second sheet feed means to the first sheet feed means is considered as a remaining one, this may automatically be discharged out of the apparatus by at least the first sheet feed means.

While a standby printable condition is maintained until a printing instruction is given, moreover, the aforementioned remaining sheet may be fed for printing as usual when the printing instruction is given by operating the first sheet feed means without operating the second sheet feed means even though the second sheet feed means is instructed to feed a sheet therefrom. When the first sheet feed means has been instructed to feed a sheet then, at least the first sheet feed means may be operated to automatically discharge the remaining sheet and subsequently operated to feed a sheet for printing. Further, with the provision of feed means other than the first and second sheet feed means, normal sheet feeding and printing may be carried out when the additional feed means is instructed to feed a sheet while the remaining sheet is left behind. In this way, the ready-for-printing condition is maintained even when one of the double fed sheets fed in a stack from the second sheet feed means is caused to remain by the first sheet feed means. The interruption of printing or the operator's work of removing the remaining paper can thus be made unnecessary.

BRIEF DESCRIPTION OF THE DRAWINGS

FIG. 2, including

FIG. 6 is a flowchart of print conveying control in the first embodiment.

DESCRIPTION OF THE PREFERRED EMBODIMENTS

Referring to the accompanying drawings, embodiments of the present invention will subsequently be described.

First Embodiment

Figure 1:
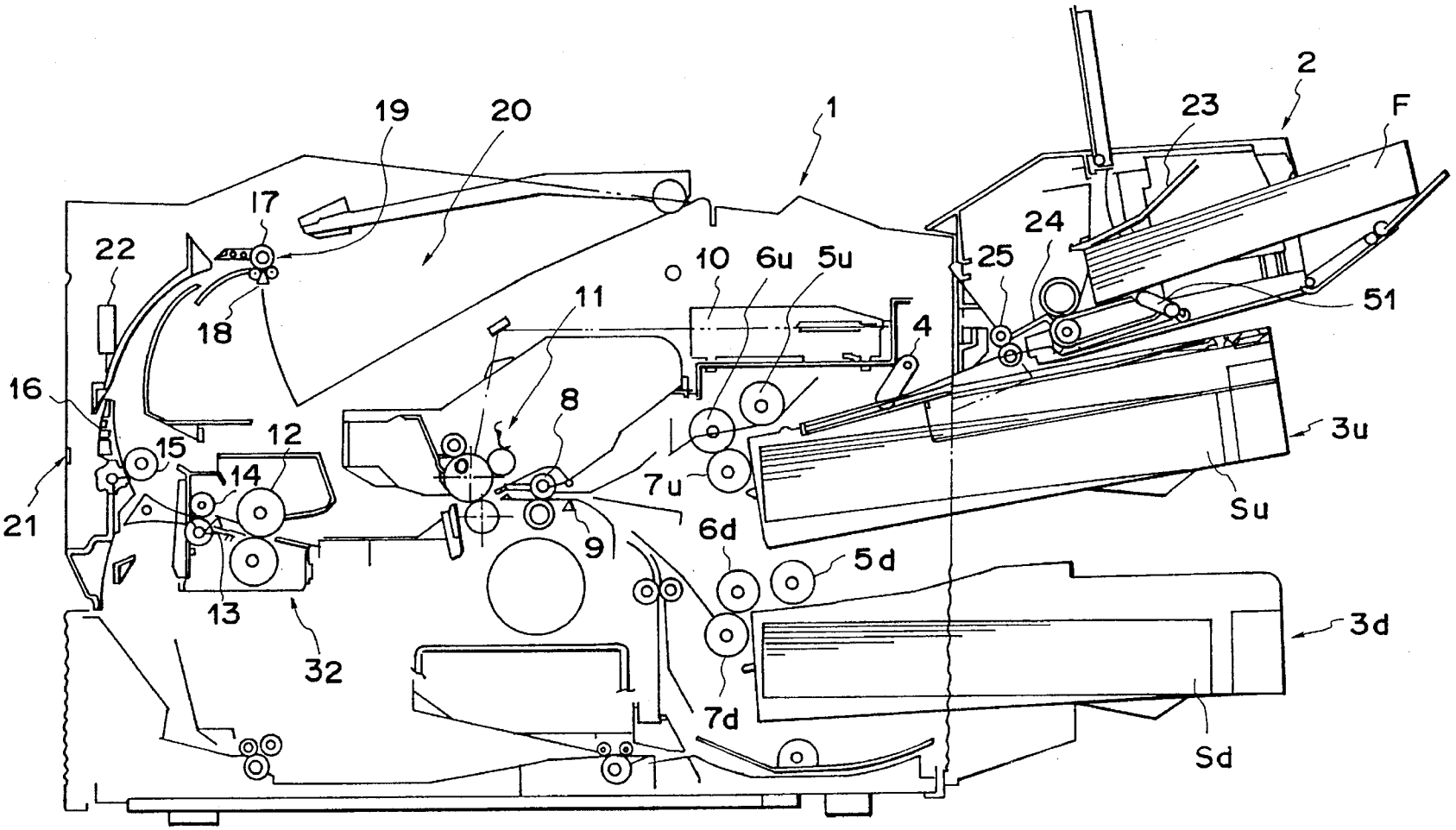
FIG. 1 is a sectional view of a laser beam printer embodying the present invention.

FIG. 1 is a sectional view of a laser beam printer 1 having an option feeder 2 as a detachable sheet feeder.

As shown in FIG. 1, a laser beam printer 1 is provided with an upper stage cassette 3*u* for accommodating recording paper Su, a pickup roller 5*u* (vertically moved by a cam mechanism (not shown)) for taking the recording paper out of the upper stage cassette 3*u*, a feed roller 6*u* for sending out the paper thus taken out, and a retard roller 7*u* for preventing multiple sheet feeding (e.g. double sheet feeding). In this case, torque smaller than what is applied to the feed roller 6*u* is applied to the retard roller 7*u* in a direction opposite to the direction of conveyance. When one sheet of paper is fed from the pickup roller 5*u*, it is conveyed with the torque of the feed roller 6*u* in the direction of conveyance. When more than one sheet of paper is fed, the uppermost paper is conveyed by the force of the feed roller 6*u* in the direction of feeding paper because the paper-to-paper frictional force is smaller than the roller-to-paper frictional force. However, the force of the feed roller is not transmitted to the retard roller 7*u*, which therefore rotates in the direction opposite to the direction of conveyance. The laser beam printer 1, using a mechanism of sending back the sheets of paper set under the uppermost sheet in due order to prevent multiple sheet feeding, also has a lower stage cassette feed mechanism, which is similar to the upper stage cassette feed mechanism, comprising a lower stage cassette 3*d* for accommodating recording paper Sd, a pickup roller 5*d*, a feed roller 6*d*, and a retard roller 7*d*. Moreover, the laser beam printer 1 is provided with an option paper feed sensor 4 for detecting envelopes F fed from the option feeder 2 which will be described later. Further, a pair of registration (register) rollers 8 for conveying the recording paper Su, Sd or the envelopes F in synchronization with image formation in an image formation unit 11 which will be described later are disposed on the downstream side of the feed rollers 5*u*, 5*d* and a pre-registration sensor 9 for detecting immediately before the pair of the registration rollers 8. In addition, the image formation unit 11 for forming an image by means of a laser beam from a laser unit 10 is arranged on the downstream side of the pair of the registration rollers 8. A fixer 12, and a fixing and discharging sensor 13 immediately following the former are also disposed on the downstream side of the image formation unit 11.

Moreover, conveying rollers 14, 15 are disposed on the downstream side of the sensor 13 and an FU (Face Up) flapper 16 is arranged on the downstream side of the roller 15. The FU flapper 16 is used to distribute sheets of paper to conveying passages directed to two paper discharge openings: namely, an FD (Face Down) paper discharge opening 19 and an FU paper discharge opening 21 which will be described later. The recording paper is discharged to the FD side when an FU flapper solenoid 22 is pulled before being returned to the FU side. A paper discharge roller 17 and a paper discharge opening sensor 18 are disposed on the downstream side of the FD of the flapper 16 so that the recording paper is discharged up to an FD tray 20.

The option feeder 2 is used to feed the envelope F and provided with an envelope presser 23, an envelope pickup belt 24, an envelope conveying roller 25, and an envelope sensor 51.

Figure 2A:
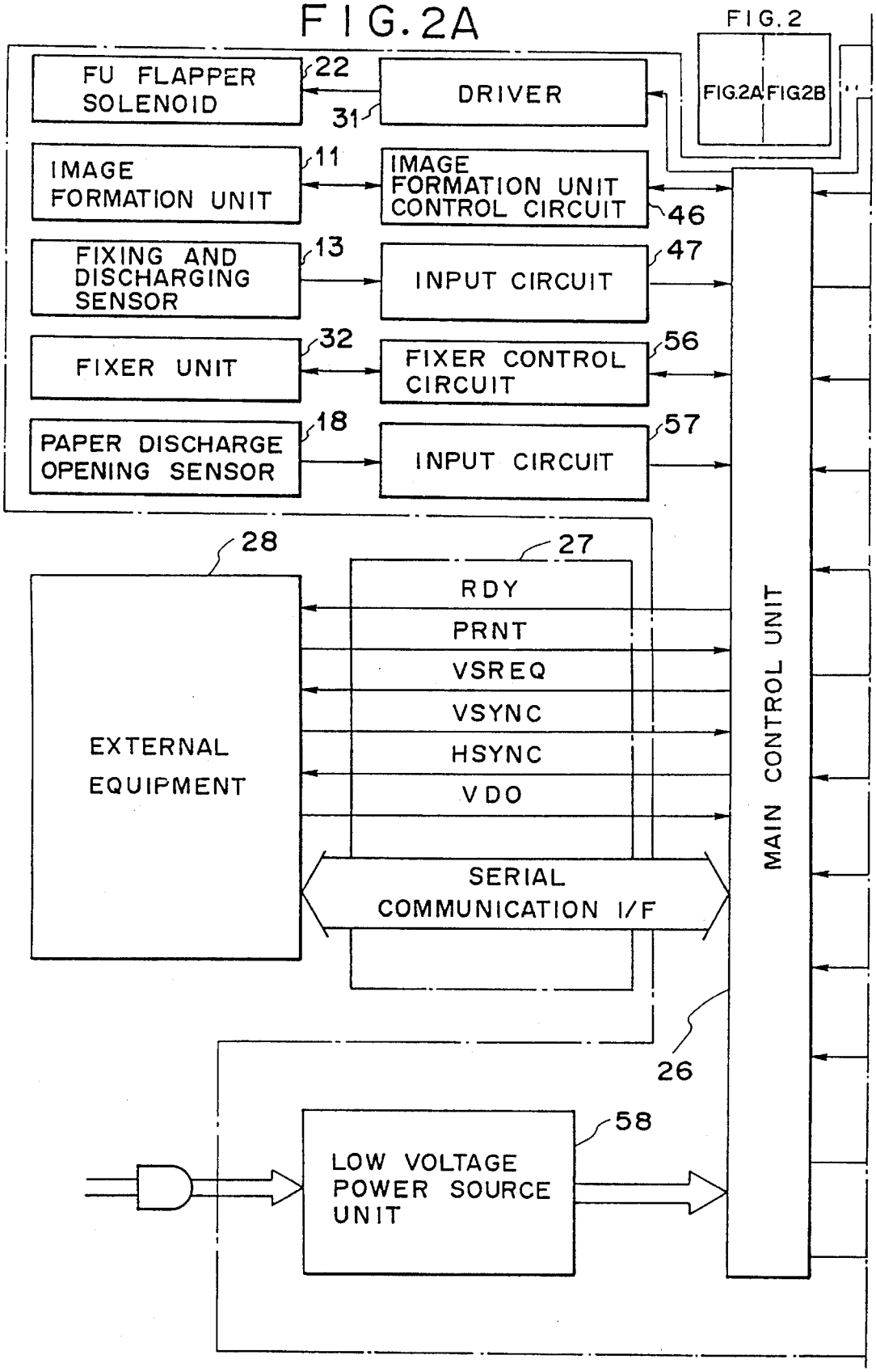
FIGS. 2A and 2B, is a block diagram illustrating an electrical configuration of the laser beam printer of FIG. 1.
Figure 2B:
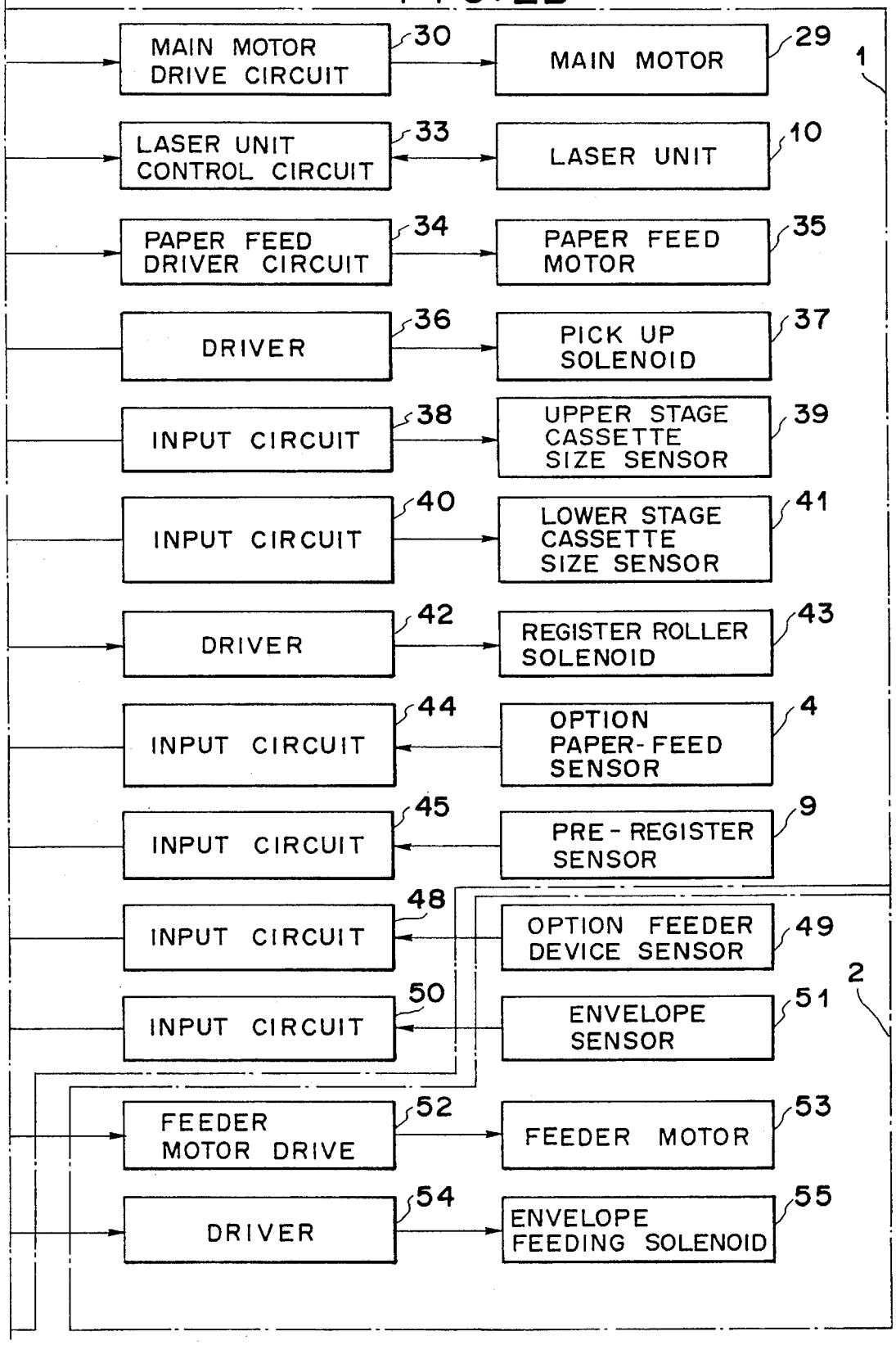

As shown in FIG. 2, an electrical configuration of the laser beam printer 1 includes a main control unit 26 and external equipment 28 is connected via an interface 27 to the main control unit 26, which comprises a microprocessor for controlling the whole printer, a ROM for storing control programs, a RAM for storing data, gate elements and the like. Further, the input/output port of the main control unit 26 is coupled via a main motor drive circuit 30 to a main motor 29 for driving each roller on the downstream side of the pair of the registration rollers 8, coupled via a laser unit control circuit 33 to the laser unit 10, coupled via an image formation unit control circuit 46 to the image formation unit, and coupled to a fixer unit 32 via a fixer control circuit 56 for controlling a built-in halogen heater of the fixer at a predetermined temperature. The input port of the main control unit 26 is connected via respective input circuits 38, 40 to an upper and a lower stage cassette size sensor 39, 41 for detecting the sizes of sheets Su, Sd respectively accommodated in the upper and lower stage cassettes 3*u*, 3*d*, connected via respective input circuits 44, 45, 47, 57 to the option paper feed sensor 4, the pre-registration (pre-register) sensor 9, the fixing and discharging sensor 13 and the paper discharge opening sensor 18, and further connected via respective input circuits 48, 50 to an option feeder device sensor 49 for detecting whether or not the option feeder 2 is fitted to the laser beam printer and the envelope sensor 51 for detecting the presence or absence of the envelope F in the option feeder.

The output port of the main control unit 26 is connected via a driver 36 to a pickup solenoid 37 for turning on/off the driving of a cam mechanism (not shown) for vertically moving the pickup roller 5*u*, connected via a driver 31 to the FU flapper solenoid 22 for turning on/off the driving of the FU flapper 16, connected via a paper feed motor drive circuit 34 to a paper feed motor 35 for driving the feed roller 6, connected via a driver 42 to a registration roller solenoid 43 for turning on/off the driving of the pair of registration rollers 8, and further connected via a driver 54 to an envelope feeding solenoid 55 for turning on/off the driving of the envelope pickup belt 24. In this case, numeral 58 denotes a low voltage power source for converting commercial AC voltage to a predetermined DC voltage.

The interface 27 is adapted for use in transmitting an RDY signal for informing that the main control unit 26 can be ready for printing with respect to the external equipment 28, a PRNT signal for the external equipment 28 to instruct the main control unit 26 to start printing, a VSREQ signal for the main control unit 26 to request the external equipment 28 to output a synchronizing signal VSYNC in the vertical direction (subscanning direction) of an image output, a synchronizing signal VSYNC in the vertical direction (subscanning direction) of the image output, a synchronizing signal HSYNC for the main control unit to request the external equipment 28 to output in the horizontal direction (main scanning direction) of the image output; the external equipment 27 being adapted to transmit an image signal VDO for serially transmitting a dot image in synchronization with the VSYNC and HSYNC signals. The interface has a handshake type serial communication line and this enables the external equipment 28 to instruct the main control unit 26 via the serial communication line to select the operation such as the cassette paper feeder and the option feeder.

Figure 3:
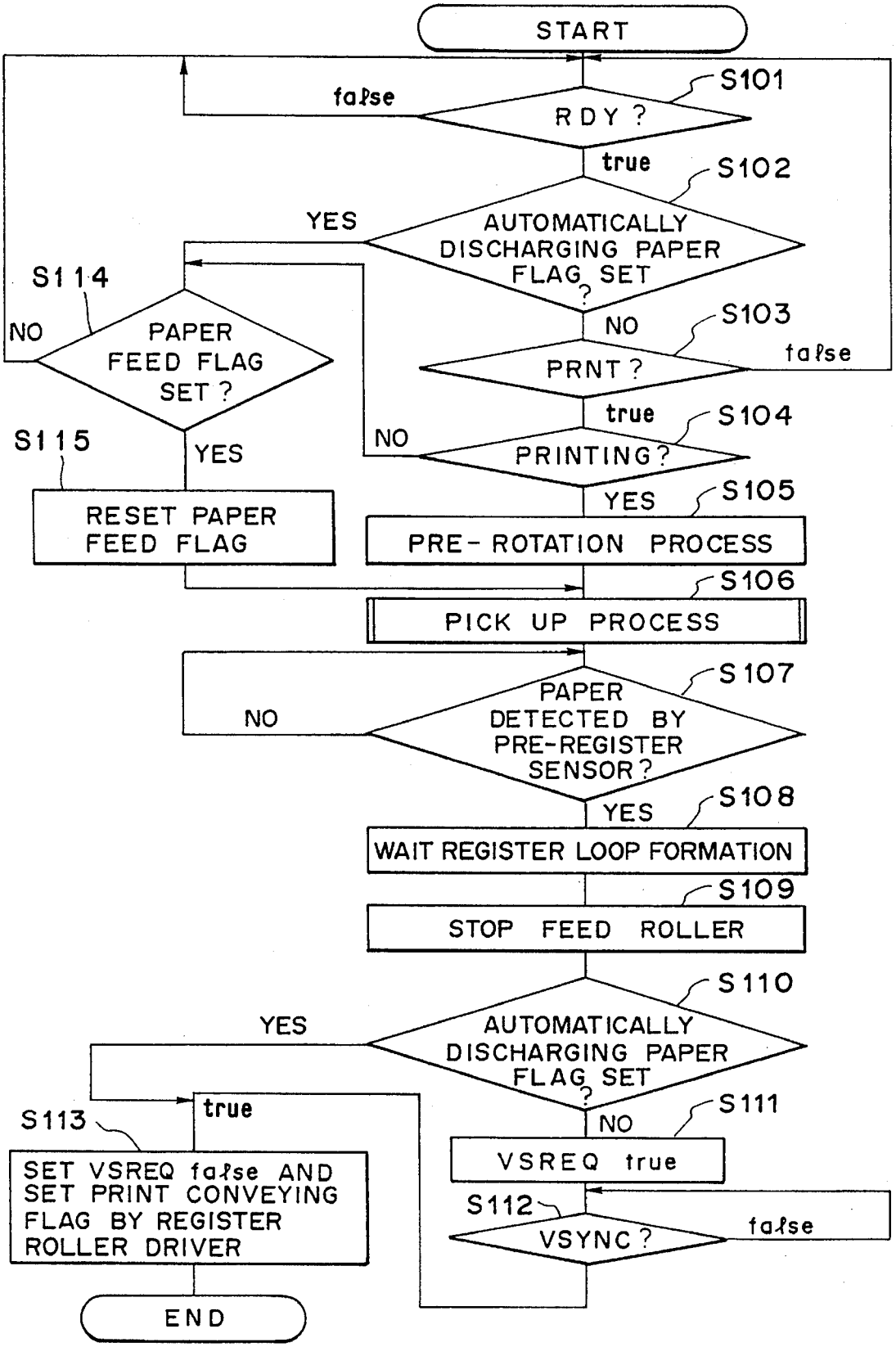
FIG. 3 is a flowchart of the operation of a first embodiment of the present invention.

Referring to flowcharts of FIGS. 3 to 7, the operation of this embodiment will be described. FIG. 3 is a flowchart of the operation of this embodiment. When power is supplied to the laser beam printer 1, the main control unit 26 performs a predetermined initializing operation and sets the RDY signal true at a point of time the recording operation becomes possible. The main control unit 26 then selects a paper feed opening from the upper and lower stage cassettes through serial communication with the operator external equipment 28 and sets the PRNT signal true with respect to the external equipment 28 after verifying that the RDY signal has been set true.

First, the main control unit 26 verifies that its own RDY signal is true at step S101 (hereinafter simply called S101) and checks an automatic paper discharging flag which will be described at S102 and if the automatic paper discharge flag is reset, moves to wait for the PRNT signal at S103. The automatic paper discharging flag is set to instruct the paper feed control to discharge paper automatically when one of the envelopes double fed from the option feeder 2 is caused to remain and is detected, in a method which will be described later, on this side of the upper stage feed roller *6u* of the printer as they are separated at the upper stage feed roller *6u* and the upper stage retard roller *7u*. While the automatic paper discharging flag is set, the main control unit 26 performs the paper feed operation without waiting for the printing instruction from the external equipment 28 on the PRNT signal and automatically discharges the remaining paper (S102).

While the automatic paper discharging flag is reset, a decision is made on whether printing is in progress at S104 when the external equipment 28 sets the PRNT signal true (S103) and if printing is not in progress, a pickup operation is performed at S106 after a pre-rotation operation is performed at S105. In this case, the rising of a polygon motor (not shown) and the main motor 29, and the initializing of an electrophotographic process are caused in the prerotation operation. If, moreover, printing is already in progress at S104 or if the automatic paper discharging flag is set (always during the printing), a paper feed flag which will be described later is checked at S114. If the paper feed flag is set, it is reset at S115 and the pickup operation of S106 is performed. If the paper feed flag is reset at S114, a standby condition is maintained until the paper feed flag is set again at S101.

Paper is picked up through a predetermined paper feed opening in accordance with a paper feed mode at S106. With respect to S106, a detailed description will be given later.

Subsequently, the arrival of the paper thus picked up at S106 at the pre-registration sensor 9 is awaited at S107 and when the pre-registration sensor 9 detects the paper, the feed roller *6u* is stopped at S109 after the paper forms a loop of predetermined amount before the registration rollers 8. Standby time at S109 is the sum of the time required for the paper to be conveyed from the pre-registration sensor 9 up to the registration rollers 8 and conveyance time equivalent to the loop amount (the amount of a bend between the feed roller *6u* and the registration rollers 8).

After the loop is formed at S109, the automatic paper discharging flag is reset at S110. In the case of normal paper feeding, S111, S112 are followed so that the VSREQ signal is set true with respect to the external equipment 28. S113 is then followed until the VSYNC signal from the external equipment 28 is set true again and the automatic paper discharging flag is set at S110, that is, S113 is directly followed when the remaining sheet of paper is subjected to the automatic paper discharging process. The VSREQ is set false at S113 and a registration roller clutch 43 is turned on via the registration roller driver 42 to drive the registration rollers 8. Then the registration rollers 8 are driven to set a print conveying flag, whereby print conveying control is effected.

Figure 4:
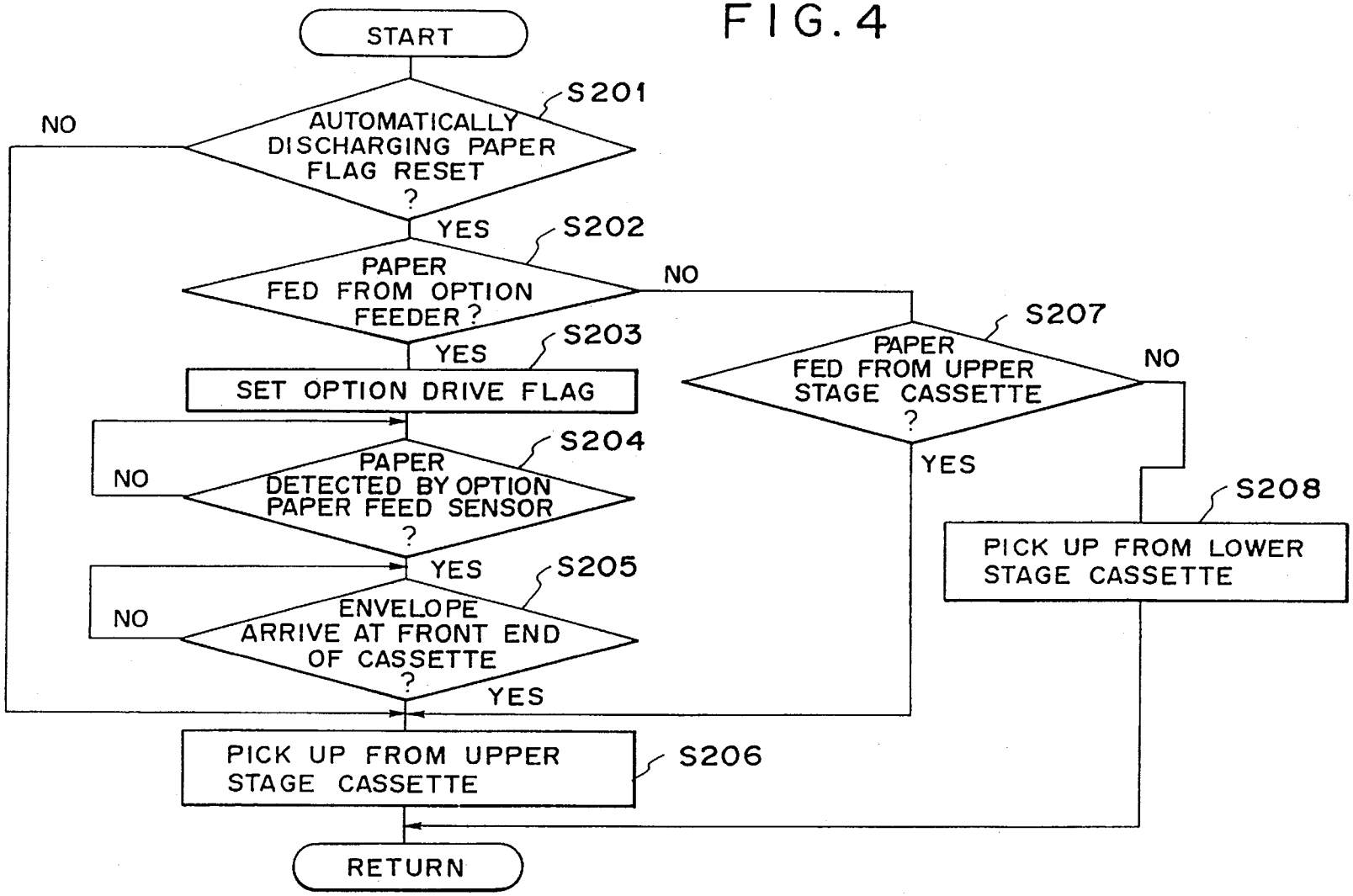
FIG. 4 is a flowchart of the pickup operation of S106 of FIG. 3.

FIG. 4 is a flowchart of the pickup operation of S106 of FIG. 3. When pickup timing is reached at S106, the automatic paper discharging flag is checked at S201 and when the automatic paper discharging flag is set, that is, when the remaining sheet of paper is automatically discharged, an upper stage pickup operation is immediately performed (S206). When the automatic paper discharging flag is reset at S201, that is, when paper is normally fed, S202 is followed and it is checked to see whether paper is fed by the option feeder. When the paper is fed by the option feeder at S202, option paper feed control which will be described later is started by setting an option drive flag at S203 and the feeding of envelopes from the option feeder 2 is started. When the option feed paper sensor 4 detects the paper while the arrival of the envelope at the option feed paper sensor 4 is awaited at S204, the pickup timing obtained from the distance from the option feed paper sensor 4 up to the leading end of the cassette and the paper conveying speed of the option feeder 2, that is, the timing at which the envelope fed from the option feeder reaches the leading end of the upper stage cassette *3u*, is waited for (S205). The upper stage pickup operation (S206) is then performed.

When option paper feeding is not the case at S202, S207 is followed and it is checked to see whether or not the upper stage cassette is used to feed paper. If the upper stage cassette is used to feed paper, the upper stage pickup operation of S206 is performed and if not, the lower stage pickup operation of S208 is performed.

In the upper stage pickup operation of S206, a cam mechanism (not shown) is operated so as to press the pickup roller *5u* against the paper in the upper stage cassette *3u* by turning the pickup solenoid 37 via the driver 36 and the upper stage pickup roller *5u* and the upper stage feed roller *6u* are rotated by the paper feed motor 35 via the paper feed motor drive circuit 34. In the lower stage pickup operation of S208 likewise, the lower stage pickup roller *5d*, and the lower stage feed roller *6d* are driven by the driver 36, the pickup solenoid 37, the paper feed motor drive circuit 34 and the paper feed motor 35. In this case, the movements of the upper and lower stage pickup rollers are interlocked and both the upper and lower stage pickup rollers *5u*, *5d* are pressed against the surface of the paper when the cam mechanism is driven. Consequently, paper is fed from the predetermined paper feed opening by rotating the pickup roller on the paper feeding side. Moreover, the upper and lower stage pickup rollers *5u*, *5d*, and the feed rollers *6u*, *6d* are rotated by the same paper feed motor 35 and the direction of rotation of the paper feed motor 35 determines to have only the upper or lower stage driven. Therefore, the main control unit 26 causes the paper feed motor drive circuit 34 to change the direction of rotation of the paper feed motor 35 in accordance with the paper feed mode so that paper is fed from the predetermined paper feed opening.

The paper feed control is restored after the pickup is started at S206 or S208.

Figure 5:
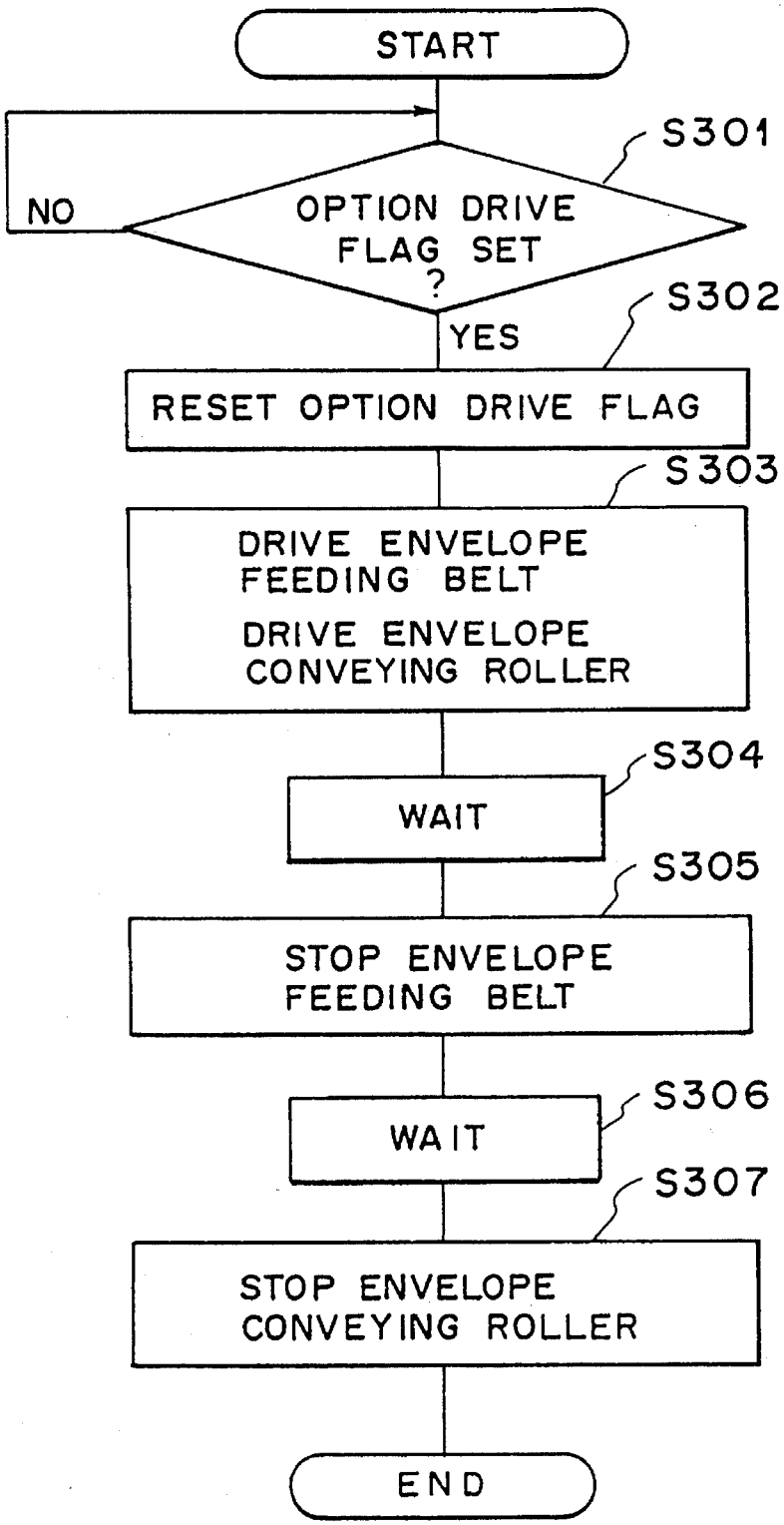
FIG. 5 is a flowchart of option paper feed control in the first embodiment.

FIG. 5 is a flowchart of option paper feed control. First, the option drive flag is set at S301 and a standby condition is maintained until an instruction as to paper feeding from the option feeder is given. When the option drive flag is set at S203 in the case of the paper fed from the option feeder in the aforementioned pickup operation, the option drive flag is reset at S302 and the envelope conveying belt 24 is driven by driving the feeder motor 53 via the feeder motor drive circuit 52 and turning on an envelope conveying clutch 55 via the driver 54. Moreover, the envelope roller 25 is driven by driving the feeder motor 53. A time long enough for an envelope to reach the envelope conveying roller is taken at S304 and then the envelope feeding clutch 55 is turned off via the driver 54 at S305 to stop only the envelope conveying belt. As the force of conveying the envelope conveying roller 25 is arranged sufficiently greater than that of holding the envelope conveying belt 24, the envelope continues to be conveyed by the envelope conveying roller 25. After a time long enough for the trailing end of the envelope thus fed to pass on the envelope conveying roller 25 is taken at S306, the feeder motor 53 is stopped via the feeder motor drive circuit 52. The necessary control is completed.

FIG. 6 is a flowchart of print conveying control in the laser beam printer 1. A standby condition is maintained until the print conveying flag is set, that is, until control is switched from the paper feed control at S401. When the print conveying flag is set by driving the registration roller 8 under the paper feed control of S113, the print conveying flag is reset at S402 and S403 is followed. The automatic paper discharging flag is checked at S403 and when the automatic paper discharging flag is reset, that is, if normal print conveying is the case, preparation is made for forming an image in the laser unit 10 and the image formation unit 11 (S404) and when the automatic paper discharging flag is set, that is, if automatic paper discharging is the case, the automatic paper discharging flag is reset (for the purpose of feeding the next sheet of paper) and a flag during discharging is set (S413). Since printing of the paper being conveyed is made under known control thereafter, the description of the operation will be omitted. However, an optical system is masked if the flag during discharging is set. The option paper feed sensor takes a time long enough for the trailing end of the paper to pass therethrough and while the option paper feed sensor is still detecting the paper for predetermined timing, it takes the step of deciding the status of the remaining sheet of paper and when no paper is detected, the print conveying operation (S406) continues. In this case, the timing at which the trailing end of the paper passes through the option paper feed sensor is obtained by dividing the length resulting from subtracting the distance between the option paper feed sensor and the registration roller from the maximum length of the envelope that can be fed by the option feeder (i.e., the distance between the trailing end of the envelope and the option paper feed sensor) by print conveying speed. A standby condition is maintained at S405 until what is obtained by adding a margin to the aforementioned time. In the case of paper feeding from other than the option feeder, the option paper feed sensor is caused to sense no paper. When the option paper feed sensor has sensed the presence of paper at S406, S408 is followed if the flag during discharging is reset at S407, and the automatic paper discharging flag is set. In other words, the presence of multiple sheets of remaining double fed paper is determined. When the automatic paper discharging flag is set at S407, S414 is followed and jamming is detected. When the automatic discharging of the remaining sheet of paper is attempted, jamming is assumed positive as long as the option paper feed sensor detects any remaining sheet of paper. If the option paper feed sensor senses no paper at S406, or when the automatic paper discharging flag is reset at S407, S409 is followed and a standby condition is maintained long enough for the leading end of the paper to reach the fixing and discharging sensor. The aforementioned timing is obtained by adding a small margin to what is obtained by dividing the distance between the registration rollers and the fixing and discharging sensor by the print conveying speed. When it is decided that the leading end of the paper can reach the fixing and discharging sensor with a time on hand at S409, the fixing and discharging sensor is checked at S410. If the presence of paper is the case, the print conveying is continued and if the absence of paper is the case, S415 is followed, whereby the RDY signal for jamming is turned off and the automatic paper discharging flag is reset. If it is assumed that one of the sheets of paper is left behind during the course from S405 up to S408 but when the paper normally fed from the option feeder is actually caused to remain in the paper feed unit of the printer, such remaining paper can be picked up precisely as jamming is deemed positive during the course from S409 to S415. A post image formation process and the paper discharging process are performed at S411 and S412, respectively, while the paper is being normally conveyed and the paper discharging flag is reset at S416 to complete the print conveying control.

Figure 7:
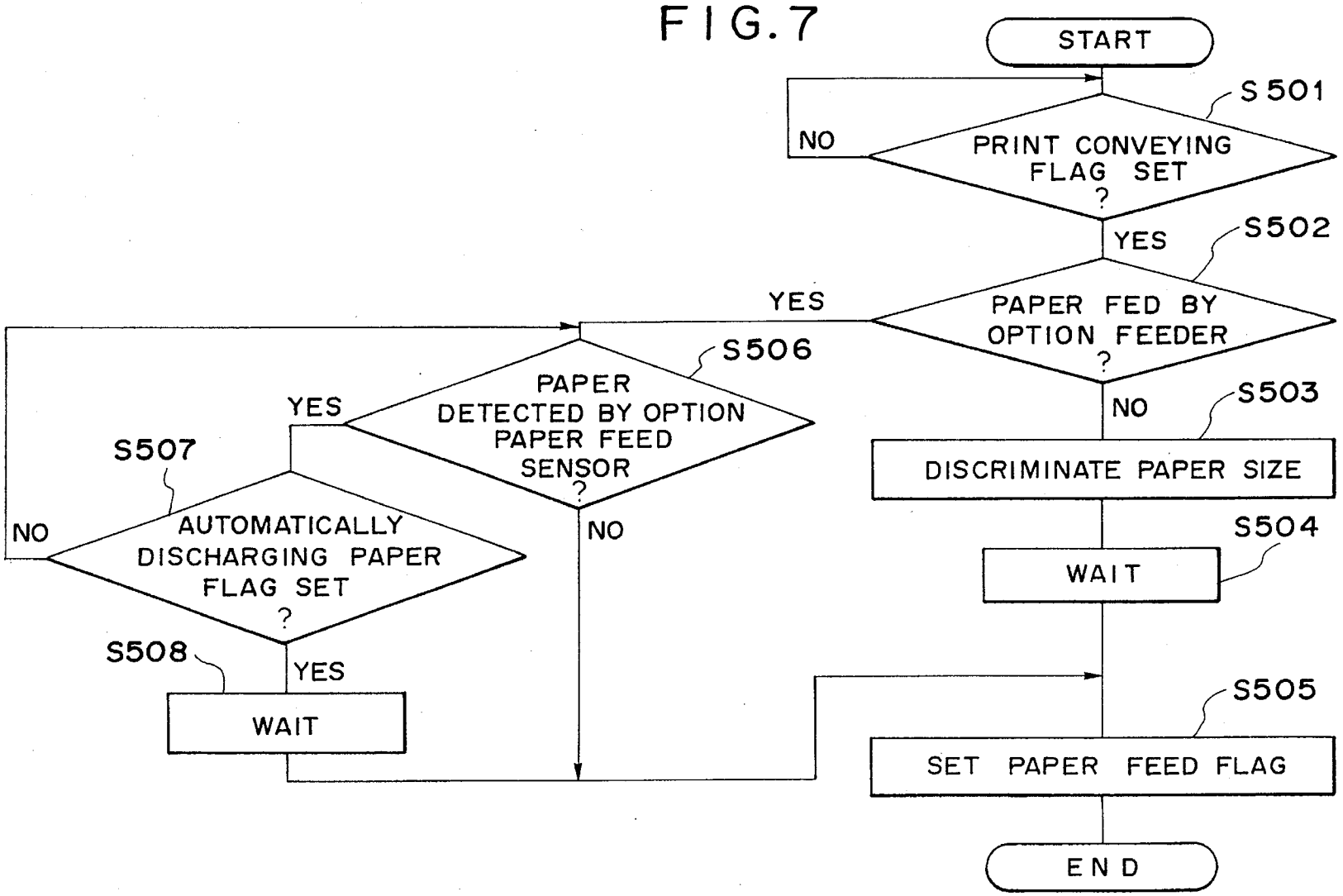
FIG. 7 is a flowchart of a paper feed decision to be made simultaneously with the print conveying control.

FIG. 7 is a flowchart of a paper feed decision to be made simultaneously with print conveying control. This process is untended for paper feed timing at which a predetermined paper-to-paper distance is secured at the time of continuous printing and the paper feed control is performed on the basis of this decision (S115 of FIG. 3). First, the setting of the print conveying flag is awaited at S501 and when it is set, a decision is made on whether option paper feeding is the case or not. When option paper feeding is not the case at S502, then the size of the paper involved is determined at S593. This means that in the case of upper stage cassette paper feeding, a decision to be made is based on the information derived from the upper stage cassette size sensor 39 via the input circuit 38 and that in the case of lower stage cassette paper feeding, it is based on the information from the lower stage cassette size sensor 41 via the input circuit 40. Subsequently, proper timing is taken at S504 so that the decision made on the paper size at S503 is utilized to provide the predetermined distance between the trailing end of the paper being put into print and the leading end of what to be fed next and the paper feed flag is set at S505. When paper is fed by the option feeder at S502, S506 is followed and a standby condition is maintained until the absence of paper, that is, the trailing end of the paper being put into print is passed through the option paper feed sensor. During the standby period, the automatic paper discharging flag is checked (S507) before being set. In other words, a standby condition is maintained until the predetermined distance between the remaining sheet of paper and what is being put into print is attained at S508 and then the paper feed flag is set at S505. When the option paper feed sensor senses the absence of paper, that is, it has passed through the option paper feed sensor normally at S506, the paper feed flag is immediately set at S505.

Under the control set forth above, the presence of the remaining sheet of paper is confirmed and it can automatically be discharged when one of the sheets of double fed paper from the option feeder 2 is isolated by the feed rollers **6*u*, 7*u*** of the printer before being caulked to remain.

Second Embodiment

When one of double fed the sheets of paper is automatically discharged, it is to be discharged through the same paper discharge opening as what is intended for printing paper to be normally discharged. However, the destination to which the paper is automatically discharged may be changed. More specifically, sheets of paper to be automatically discharged are discharged into a paper discharge opening different from what has been predetermined in the case of an image recording apparatus having a plurality of paper discharge openings like the laser beam printer of FIG. 1 shown by way of example, in order to separate them from those of ordinary printing paper, whereby the paper automatically discharged is prevented from being inserted in between the sheets of paper that have been discharged in an ordinary way during the continuous printing operation.

Although a decision to be made on the remaining sheet of paper and control over the automatic paper discharging are similar to those in the first embodiment, the following control is exercised over the processing of paper to be automatically discharged (S412 of FIG. 6).

Figure 8:
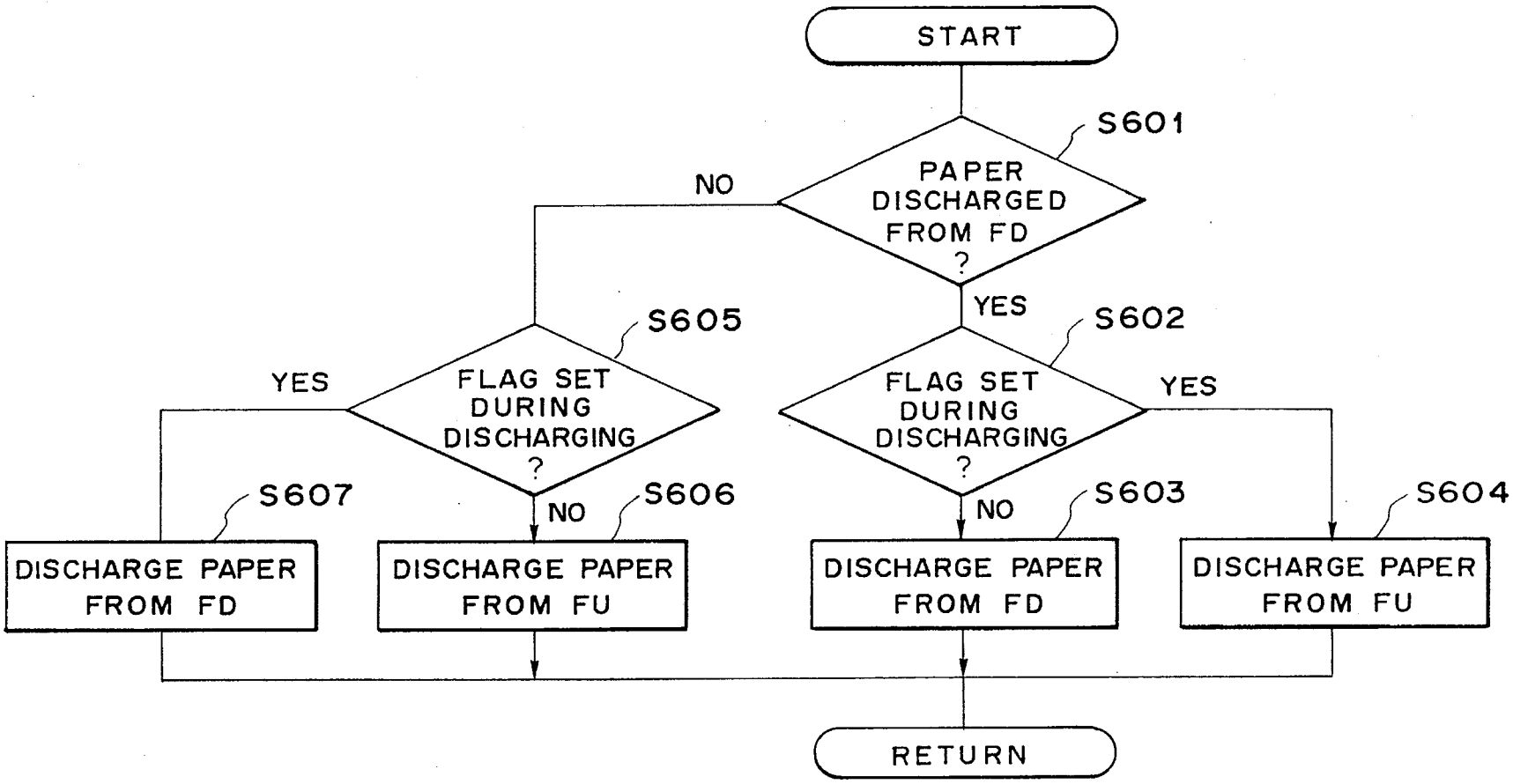
FIG. 8 is a flowchart of a paper discharge operation in a second embodiment of the present invention.

FIG. 8 is a flowchart of a paper discharge operation in the second embodiment of the present invention. This embodiment refers to the operation of discharging paper in the laser beam printer shown in FIG. 1. As stated above, the laser beam printer also has the FD (Face Down) and FU (Face Up) paper discharge openings 20, 21 and the switching of them is effected by using the FU flapper 16 to move the FU flapper solenoid 22. In other words, the FU flapper 16 is made to stay home when the paper is discharged into the FD paper discharge opening, whereas when it is discharged into the FU paper discharge opening, the FU flapper 16 is moved up by pulling the FU flapper solenoid 22 via the driver 31, so that the paper conveying passage is switched to the FU side. First, a decision is made on whether the paper designated then is directed to FD or FU at S601 of FIG. 8 and if it is directed to FD, S602 is followed in order to check the flag during discharging. As a result, the flag during discharging is reset, that is, ordinary printing paper is directed to the designated FD paper discharge opening (S603) or when the flag during discharging is set, the paper involved is discharged into the FU paper discharge opening (S604). Provided FU paper discharging is designated at S601, S605 is followed and when the flag during discharging is reset likewise, the paper is discharged into the designated FU paper discharge opening (S606) or it is discharged into the FD paper discharge opening with the flag during discharging being set (S607).

Third Embodiment

When one of the sheets of double fed paper is found remaining, it is discharged automatically and unconditionally in the first embodiment. If, however, such remaining sheet of paper is reusable, it may be used for normal printing. In this case, though print conveying control and a decision to be made on the remaining sheet of paper are similar to those referred to in the first and second embodiments, the remaining sheet of paper is not automatically discharged immediately after its presence is confirmed but is held until the next printing instruction is given by means of a PRINT signal from the external equipment 28. At a point of time the printing instruction together with the paper opening as designated is issued, a decision is made on whether the remaining paper is reused or automatically discharged, or held as it was.

Figure 9:
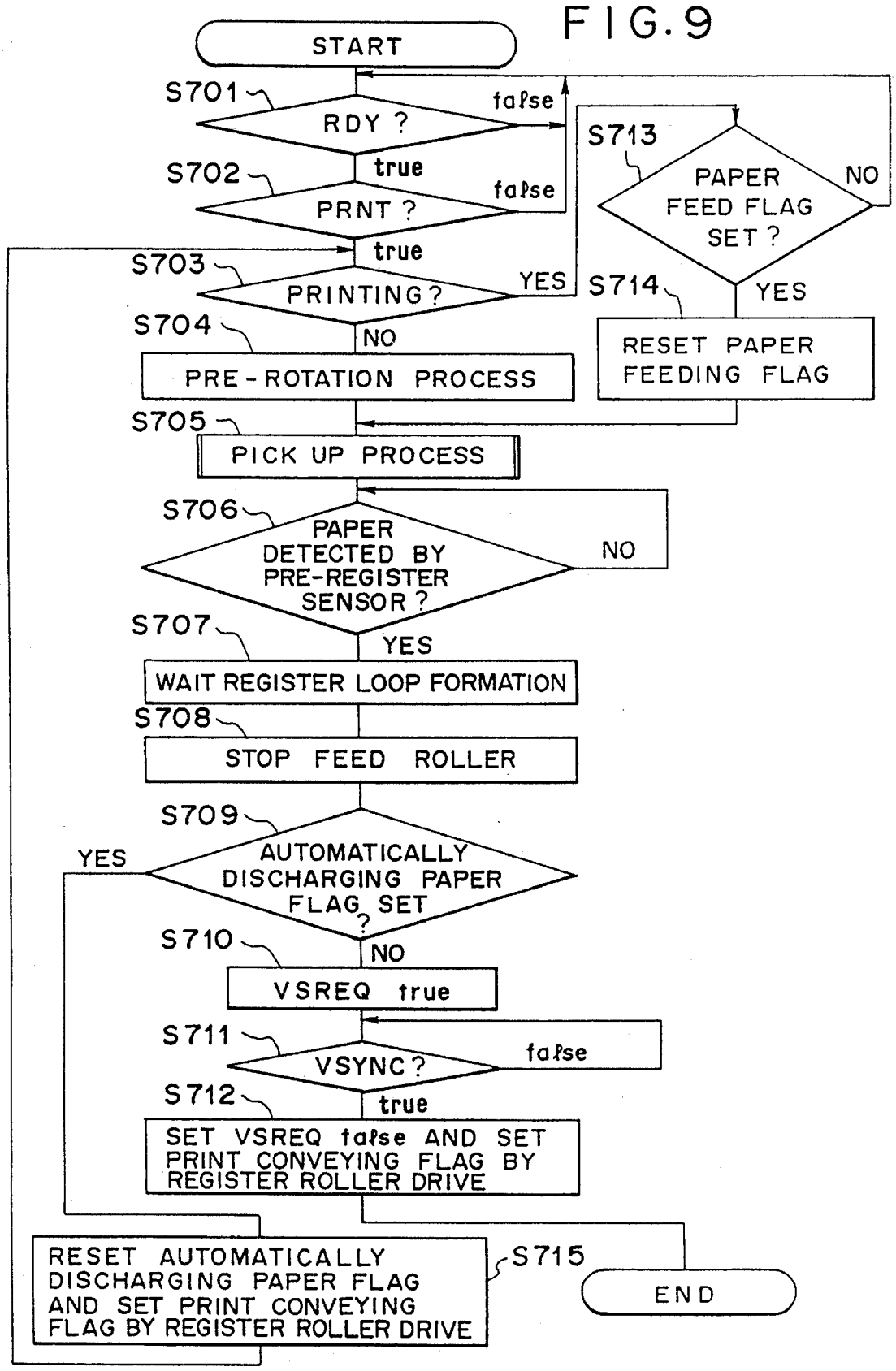
FIG. 9 is a flowchart of paper feed control in a third embodiment of the present invention.

FIG. 9 is a flowchart of paper feed control in a case where this method is used for the laser beam printer of FIG. 1. As in the first embodiment, S701 and S702 each refer to RDY check and PRNT on standby. However, the automatic paper discharge flag is not checked during this time. Operations at S703, S704, S713, S714 are similar to those at S104, S105, S114, S115 in the first embodiment, respectively. When paper can be feed through these steps, the pickup operation is performed at S705. When the automatic paper discharge flag is set, the operations are sorted at follows: under the instruction for option paper feeding, reutilization; under the instruction for upper stage cassette paper feeding, automatic paper discharging; and under the instruction for lower stage cassette paper feeding, the remaining sheet of paper feeding. The pickup operation will be described in detail later. The operations during the course from S707 to S708 after the pickup operation and those from S710 up to S712 with the automatic paper discharge flag being reset at S709 are similar to those from S108 to S109 and from S111 up to S113 in the first embodiment, respectively. When the automatic paper discharge flag is set at S709, S715 is followed so as to cause the automatic paper discharge flag to be reset, the registration rollers to be driven and the print conveying flag to be set. S703 is then followed and the paper feed operation is also performed again. The automatic paper discharge flag is set at S709 only when the remaining sheet of paper exists during the pickup operation at S705 and when the upper stage cassette feed is designated as will be described later. In the case of other kinds of paper feed instructions, the automatic paper discharge flag that has been set is reset when the pickup operation is performed. In other words, an operation led to S703 through S709 up to S715 is performed so that paper is normally fed again from the upper stage cassette after the remaining sheet of paper is automatically discharged, provided the remaining sheet of paper exists under the instruction for upper stage cassette paper feeding.

Figure 10:
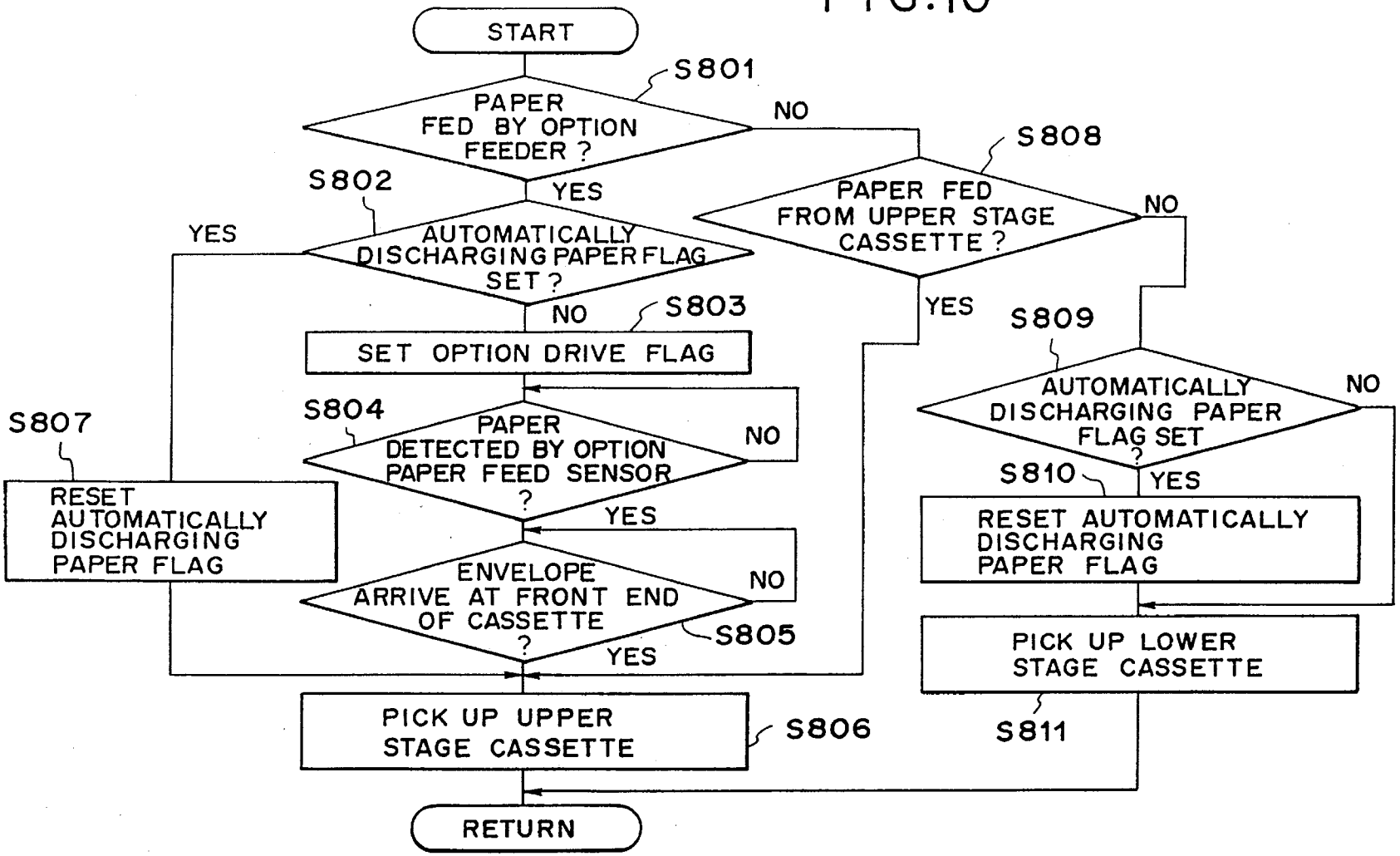
FIG. 10 is a flowchart of a pickup operation in the third embodiment.

FIG. 10 is a detailed flowchart of the pickup operation (S705 of FIG. 9) in the third embodiment.

Whether paper is fed by the option feeder or not is checked at S801 and if it is designated to feed paper by the option feeder, S802 is followed. The automatic paper discharge flag is checked at S802 and when the automatic paper discharge flag is reset, normal option feeder paper feed control is effected at and after S803. Operations from S803 to S806 are similar to those from S203 up to S206 of FIG. 4 in the first embodiment. When the automatic paper discharge flag is set at S802, that is, when there is a remaining sheet of paper in the case of the option paper feeding, S807 is followed. Then the automatic paper discharge flag is reset and the upper stage pickup operation of S806 is performed. In this way, the remaining sheet of paper is reusable as ordinary printing paper.

If it is designated not to feed paper by the option feeder at S801, S808 is followed and whether paper is fed from the upper stage cassette or not is checked. If it is designated to feed paper from the upper stage cassette at S808, S806 is followed and the upper stage pickup operation is performed. The state of the automatic paper discharge flag remains unchanged. Although no paper is fed from the upper stage cassette when the remaining sheet of paper exists since the same pickup mechanism of the apparatus is used to feed paper from the option feeder and also from the upper stage cassette, the automatic paper discharge flag is set if the upper stage cassette is designated to feed paper under the paper conveying control, that is, the pickup operation is performed again after the remaining sheet of paper, if any, is picked up once before being automatically discharged and paper is fed from the upper stage cassette for printing.

If the lower stage cassette is designated to feed paper at S808, S809 is followed and the automatic paper discharge flag is checked. When the automatic paper discharge flag is set at S809, the automatic paper discharge flag is reset at S810 and S811 is followed. When the automatic paper discharge flag is reset, S811 is directly followed and the lower stage pickup operation is performed. As a result, the automatic paper discharge flag is set when the lower stage cassette is designated to feed paper, that is, paper is fed from the lower stage cassette when there exists the remaining sheet of paper, which is left as it was. When the paper picked up from the lower stage cassette is conveyed for printing, the option paper feed sensor senses paper through operations of from S406 up to S408 of FIG. 6 and the automatic paper discharge flag is set again. Therefore, the remaining sheet of paper is left as it was until the upper stage cassette is designated to feed paper after the option feeder is designated to feed paper.

Under the aforementioned control, printing may be continued even when one of multiple sheets of double fed paper from the option feeder is caused to remain and the remaining sheet of paper may be used as ordinary printing paper as long as it is reusable. Waste of paper can thus be prevented.

With the aforementioned arrangement, the printing condition can be continued without the participation of the operator even when one of the sheets of double fed paper is caused to remain between two sheet feeder devices of the image recording apparatus.

By continuing on the printing operation even when one of the sheets of paper is left behind, the sheet being printed is prevented from being wasted and as it is reusable, neither one of the sheets is wasted.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. An image forming apparatus comprising:

recording means for recording an image on a recording medium;

a first loading unit for loading a recording medium;

a second loading unit for loading a recording medium;

first feeding means for feeding a recording medium from said first loading unit;

second feeding means for feeding a recording medium fed by said first feeding means to said recording means, and for feeding a recording medium from said second loading unit to said recording means, and for separating multiply fed recording mediums;

first detecting means for detecting a multiple feed state; and discriminating means for discriminating whether a next sequential image is to be recorded on either recording medium fed from said first or second loading unit when the multiple feed state is detected, wherein said recording means records the next sequential image on a remaining sheet of the multiply fed recording mediums whenever the next sequential image is discriminated to be recorded on the recording medium fed from said first loading unit; and wherein said apparatus discharges a remaining sheet of the multiply fed recording mediums without said recording means recording an image thereon whenever the next sequential image is discriminated to be recorded on the recording medium fed from said second loading unit.

2. An image forming apparatus as claimed in claim 1, further comprising second detecting means for detecting a jammed state of a recording medium.

3. An image forming apparatus as claimed in claim 1, wherein said first feeding means is detachably fitted to said apparatus.

4. An image forming apparatus as claimed in claim 2, wherein said apparatus operates in a non-printing condition when a jammed state is detected by said second detecting means and operates in a printing condition when a multiple feed state is detected by said first detecting means.

5. An image forming apparatus as claimed in claim 4, wherein said apparatus discharges a remaining recording medium on which an image is not recorded, at a position different from a discharging position of a recording medium on which an image is recorded.

6. An image forming apparatus as claimed in claim 1, further comprising:

a first sensor, provided downstream of said first feeding means, for detecting a presence of a recording medium; and a second sensor provided between said first feeding means and said second feeding means, wherein said first detecting means detects a multiple feed state on the basis of an output from said first sensor and an output from said second sensor when both said first and second sensors detect a recording medium after a predetermined time elapses from the start of a feeding operation by said second feeding means.

7. An image forming apparatus as claimed in claim 2, further comprising:

a first sensor, provided downstream of said first feeding means, for detecting a presence of a recording medium; and a second sensor provided between said first feeding means and said second feeding means, wherein said second detecting means detects a jammed state on the basis of an output from said first sensor and an output from said second sensor when said first sensor does not detect a recording medium and said second sensor detects a recording medium after a predetermined time elapses from the start of a feeding operation by said second feeding means.

8. An image forming apparatus as claimed in claim 1, further comprising:

a third loading unit for loading a recording medium; and third feeding means for feeding a recording medium from said third loading unit to said recording means independently of said second feeding means.

9. An image forming apparatus as claimed in claim 8, wherein said discriminating means discriminates whether the next sequential image is to be recorded on the recording medium fed from any one of said first, second, and third loading units.

10. An image forming apparatus as claimed in claim 9, wherein said apparatus records the next sequential image on the recording medium fed by said third feeding means without discharging the remaining sheet of the multiply fed recording mediums.

11. A method for an apparatus having a first and a second loading unit for loading recording media, said method comprising the steps of:

feeding a recording medium fed by a first feeding unit to a recording unit using a second feeding unit when a recording medium is fed from the first loading unit, said second feeding unit being usable for feeding a recording medium from the second loading unit to the recording unit and having a function for separating multiply fed recording media;

detecting a multiple feed state;

discriminating whether a next image is to be recorded on either recording medium fed from the first or the second loading unit when the multiple feed state is detected;

recording the next image on a remaining sheet of the multiply fed recording media in a case that the next image is discriminated to be recorded on the recording medium fed from the first loading unit; and discharging a remaining sheet of the multiply fed recording media without recording an image thereon in a case that the next image is discriminated to be recorded on the recording medium fed from the second loading unit.

* * * * *

UNITED STATES PATENT AND TRADEMARK OFFICE

CERTIFICATE OF CORRECTION

PATENT NO. : 5,481,336
DATED : January 2, 1996
INVENTOR(S) : TATSUTO TACHIBANA, ET AL.

It is certified that error appears in the above-indentified patent and that said Letters Patent is hereby corrected as shown below:

Column 8,
line 22, "untended" should read --intended--.

Signed and Sealed this

Fourteenth Day of May, 1996

*Attest:*

Bruce Lehman

BRUCE LEHMAN

*Attesting Officer*

*Commissioner of Patents and Trademarks*